US011511960B2

(12) United States Patent
Choi et al.

(10) Patent No.: US 11,511,960 B2
(45) Date of Patent: Nov. 29, 2022

(54) STAPLING DEVICE OF PAPER FINISHING DEVICE

(71) Applicant: KRDC LTD., Seoul (KR)

(72) Inventors: Yong Suk Choi, Seoul (KR); Seung Kyoon Noh, Guri-si (KR)

(73) Assignee: KRDC LTD.

( * ) Notice: Subject to any disclaimer, the term of this patent is extended or adjusted under 35 U.S.C. 154(b) by 0 days.

(21) Appl. No.: 17/460,158

(22) Filed: Aug. 27, 2021

(65) Prior Publication Data

US 2022/0063952 A1 Mar. 3, 2022

(30) Foreign Application Priority Data

Sep. 1, 2020 (KR) ..... 10-2020-0111142

(51) Int. Cl.
*B65H 37/04* (2006.01)

(52) U.S. Cl.
CPC ..... *B65H 37/04* (2013.01)

(58) Field of Classification Search
CPC ..... B65H 2408/122; B65H 2408/1222; G03G 2215/00848; G03G 2215/00864
See application file for complete search history.

(56) References Cited

U.S. PATENT DOCUMENTS 7,063,248 B2 * 6/2006 Noh ..... G03G 15/6573 227/111
9,586,429 B2 * 3/2017 Nakagomi ..... B65H 43/02
10,059,025 B2 * 8/2018 Baek ..... B31F 5/001
10,077,165 B2 * 9/2018 Ahn ..... B42B 4/00
2018/0281226 A1 * 10/2018 Lee ..... B27F 7/36

FOREIGN PATENT DOCUMENTS

JP 2016199397 A 12/2016
KR 100426600 B1 4/2004

* cited by examiner

*Primary Examiner* — Leslie A Nicholson, III
(74) *Attorney, Agent, or Firm* — Renaissance IP Law Group LLP

(57) ABSTRACT

A stapling device of a paper finishing device of one embodiment of the present disclosure includes a stapler including an entrance into which one side of paper is inserted, a moving part including a stapler moving bracket on which the stapler is seated and a moving roller installed on the stapler moving bracket, a driving part which moves the stapler moving bracket, a base frame on which the stapler moving bracket and the driving part are installed, and which includes a horizontal guide surface extending along the one side of the paper, a first corner stapling guide surface spaced apart from the horizontal guide surface, and a first inclined guide surface which diagonally connects the horizontal guide surface and the first corner stapling guide surface, and a position guide part which is installed on the base frame and includes a second corner stapling guide surface and a second inclined guide surface which diagonally connects the horizontal guide surface and the second corner stapling guide surface and is inclined to be opposite to the first inclined guide surface.

10 Claims, 13 Drawing Sheets

STAPLING DEVICE OF PAPER FINISHING DEVICE

CLAIM FOR PRIORITY

This application claims priority to Korean Patent Application No. 10-2020-0111142 filed on Sep. 1, 2020, in the Korean Intellectual Property Office (KIPO), the entire contents of which are hereby incorporated by reference.

BACKGROUND

1. Technical Field

Example embodiments of the present disclosure relate to a stapling device of a paper finishing device, and more specifically, to a stapling device of a paper finishing device having a simplified structure for a posture change for clinching of a stapler.

2. Related Art

Image forming devices, which form letters or pictures on paper, generally include printers, copiers, scanners, fax machines, or multifunction devices including one or more thereof. An image forming devices form letters or pictures on one surface or both surfaces of a sheet while automatically feeding sheets having various sizes. There are many cases in which finishing devices referred to as "finishers" are additionally applied to the image forming devices such as copiers, fax machines, scanners, and printers.

FIG. 1 is a view illustrating an example of an image-forming device and a finishing device.

In FIG. 1, a paper relay device 20 may be provided between an image forming device 10 and a finishing device 30. The image forming device forms a picture (for example, text or image) on paper. The paper on which the picture is formed may pass through the paper relay device and may be transferred to the finishing device 30 along a paper transfer path.

The finishing device may perform a bookbinding operation of properly ejecting the paper transferred from the paper relay device 20, arranging the ejected paper or stapling the ejected paper, and the like.

The bookbinding operation may be performed when the number of sheets of the paper ejected and arranged on a fence 31 becomes a specific number. That is, when the sheets of the paper are consecutively ejected from the finishing device 30, and the specific number of the sheets of the paper are arranged on the fence 31 positioned adjacent to a paper ejection module, the bookbinding operation of stapling the corresponding number of sheets of the paper may be performed.

Generally, a stapler employed in the image forming device or the finishing device may automatically move to a stapling operation position and staple a paper bundle which is processed by and ejected from the image forming device or the finishing device.

Several types of paper bundle stapling are generally preferred. For example, there are a horizontal type stapling (horizontal stapling) for stapling in a direction D1 parallel to an upper side of the paper and a diagonal type stapling (corner stapling) for stapling at both edge sides of an upper end thereof in a diagonal direction with respect to the upper side.

The stapler employed in the image forming device or the finishing device automatically moves to a stapling position according to a user's preset needs and performs a stapling operation. To this end, the stapler should perform not only a linear movement for the horizontal stapling but also a rotating movement for the diagonal type stapling (corner stapling).

Furthermore, it is necessary to perform the stapling operation on a paper bundle which is externally inserted by a user in addition to the paper bundle which is processed by and ejected from the image forming device or the finishing device.

Although a configuration using a guide slot, a roller, a bumper, and the like to perform the linear movement and the rotating movement of the stapler has been disclosed, since the configuration is complex and a control method is complex, there is a risk of failure and inefficiency in manufacturing.

SUMMARY

Accordingly, example embodiments of the present disclosure are provided to substantially obviate one or more problems due to limitations and disadvantages of the related art.

Example embodiments of the present disclosure provide a stapling device having a simplified structure for achieving a posture change such as a linear movement and rotating movement of a stapler used in a paper finishing device so that control is easy and operational reliability is improved.

However, objectives to be solved by the present disclosure are not limited to the above-described objectives, and other objectives which are not described above will be clearly understood by those skilled in the art through the following specification.

In some example embodiments, a stapling device of a paper finishing device includes a stapler including an entrance into which one side of paper is inserted, a moving part including a stapler moving bracket on which the stapler is seated and a moving roller installed on the stapler moving bracket, a driving part which moves the stapler moving bracket, a base frame on which the stapler moving bracket and the driving part are installed, and which includes a horizontal guide surface extending along the one side of the paper, a first corner stapling guide surface spaced apart from the horizontal guide surface, and a first inclined guide surface which diagonally connects the horizontal guide surface and the first corner stapling guide surface, and a position guide part which is installed on the base frame and includes a second corner stapling guide surface and a second inclined guide surface which diagonally connects the horizontal guide surface and the second corner stapling guide surface and is inclined to be opposite to the first inclined guide surface, wherein, when the moving roller is positioned on the horizontal guide surface, the stapling device is in a horizontal stapling mode, when the moving roller is moved along the first inclined guide surface and positioned on the first corner stapling guide surface, the stapling device is in a first corner stapling mode in which the stapler moving bracket is positioned to be inclined in a counterclockwise direction, and when the moving roller is moved along the second inclined guide surface and positioned on the second corner stapling guide surface, the stapling device is in a second corner stapling mode in which the stapler moving bracket is positioned to be inclined in a clockwise direction.

The position guide part may include a position guide bar including the second corner stapling guide surface, and a guide gate of which one end is rotatably coupled to the position guide bar and the other end is positioned on the horizontal guide surface, and on which the second inclined guide surface is formed.

Based on a direction perpendicular to the horizontal guide surface, the first inclined guide surface may be inclined in the counterclockwise direction, the second inclined guide surface may be inclined in the clockwise direction, and the first corner stapling guide surface and the second corner stapling guide surface may be parallel to the horizontal guide surface.

In the horizontal stapling mode, the moving roller is positionable at a selected position on the horizontal guide surface, and the moving roller is positionable on the horizontal guide surface in a state in which the moving roller is moving on the horizontal guide surface toward the first inclined guide surface and pushing and opening the guide gate or after the moving roller opens and passes through the guide gate.

After the moving roller opens and passes through the guide gate, the guide gate may be returned to an original position by a restoring force or gravity.

After the moving roller opens and passes through the guide gate, the moving roller positioned between the first inclined guide surface and the second inclined guide surface may collide with the first inclined guide surface, roll along the first inclined guide surface, and move to the first corner stapling guide surface in the first corner stapling mode, and may collide with the second inclined guide surface, roll along the second inclined guide surface, and move to the second corner stapling guide surface in the second corner stapling mode.

As the moving roller collides with the first inclined guide surface and rolls along the first inclined guide surface, the stapler moving bracket may rotate in the counterclockwise direction, and as the moving roller collides with the second inclined guide surface and rolls along the second inclined guide surface, the stapler moving bracket may rotate in the clockwise direction.

The moving roller may be separated from an end of the second corner stapling guide surface toward the horizontal guide surface and returned to the horizontal stapling mode.

The driving part may include a guide rod installed on the base frame to be parallel to the first horizontal guide surface, and a stapler moving bush which slides along the guide rod and is installed on the stapler moving bracket so that the stapler moving bracket is rotatable.

A distance between a rotary shaft of the stapler moving bracket and the moving roller with respect to the stapler moving bush may be greater than a distance from each of the first corner stapling guide surface and the second corner stapling guide surface to the guide rod.

BRIEF DESCRIPTION OF DRAWINGS

Example embodiments of the present disclosure will become more apparent by describing example embodiments of the present disclosure in detail with reference to the accompanying drawings, in which.

DESCRIPTION OF EXAMPLE EMBODIMENTS

Since the present disclosure allows for various changes and numerous embodiments, specific embodiments will be illustrated in the accompanying drawings and given in the detailed description. However, this is not intended to limit the present disclosure to the specific embodiments, and it is to be appreciated that all changes, equivalents, and substitutes that do not depart from the spirit and technical scope of the present disclosure are encompassed in the present disclosure. Like numbers refer to like elements throughout the description of the figures.

Unless otherwise defined, all terms (including technical and scientific terms) used herein are to be interpreted as is customary in the art to which this disclosure belongs. It should be further understood that terms in common usage should also be interpreted as is customary in the relevant art and not in an idealized or overly formal sense unless expressly so defined herein.

Hereinafter, exemplary embodiments of the disclosure will be described in detail with reference to the accompanying drawings.

Figure 2:
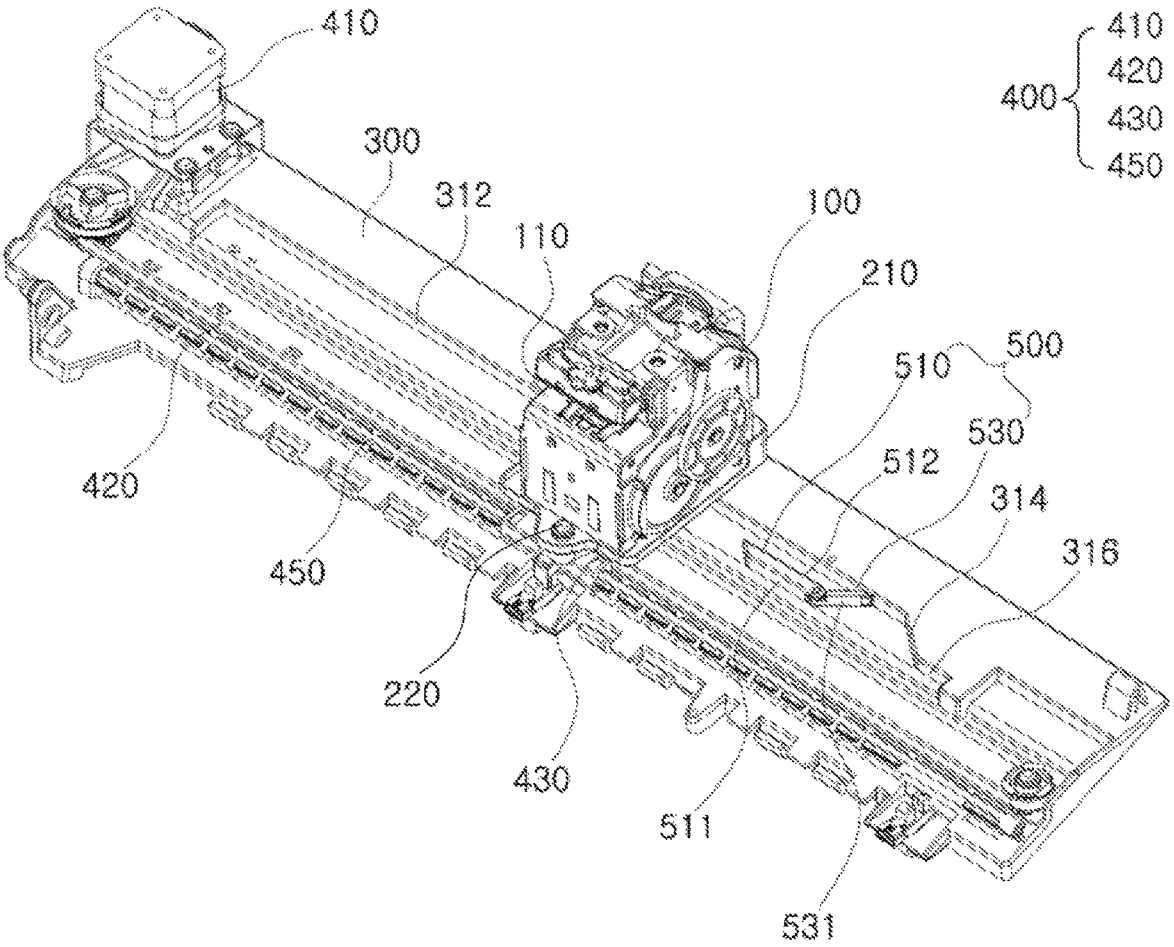
FIGS. 2 and 3 are views illustrating a stapling device of a paper finishing device according to one embodiment of the present disclosure.
Figure 3:
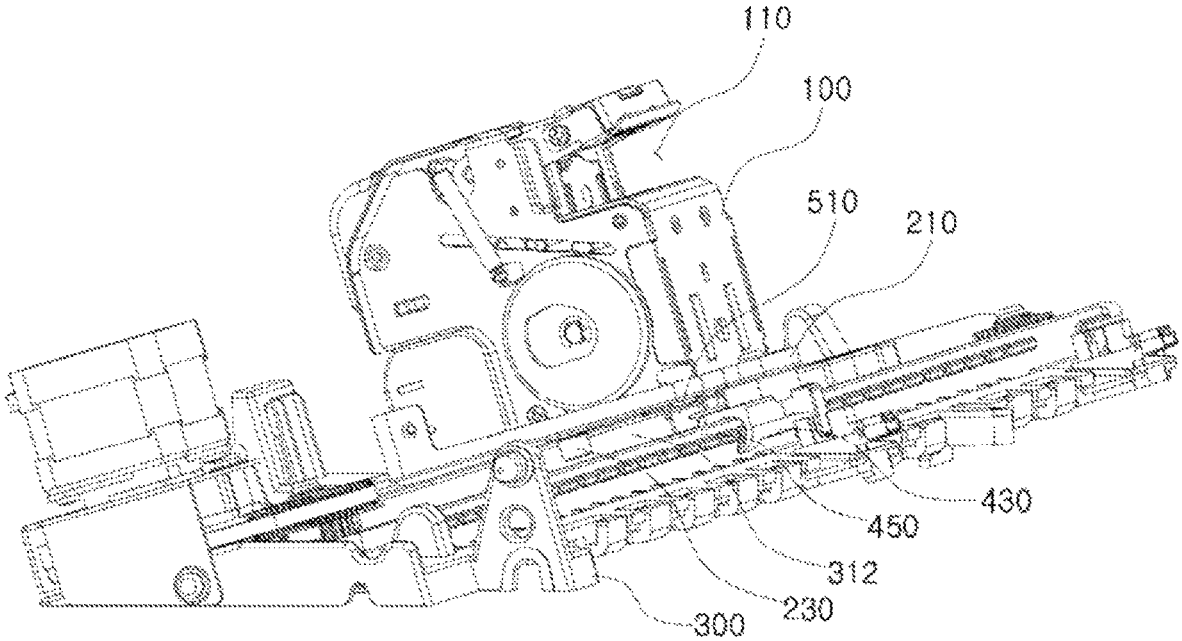
Figure 4:
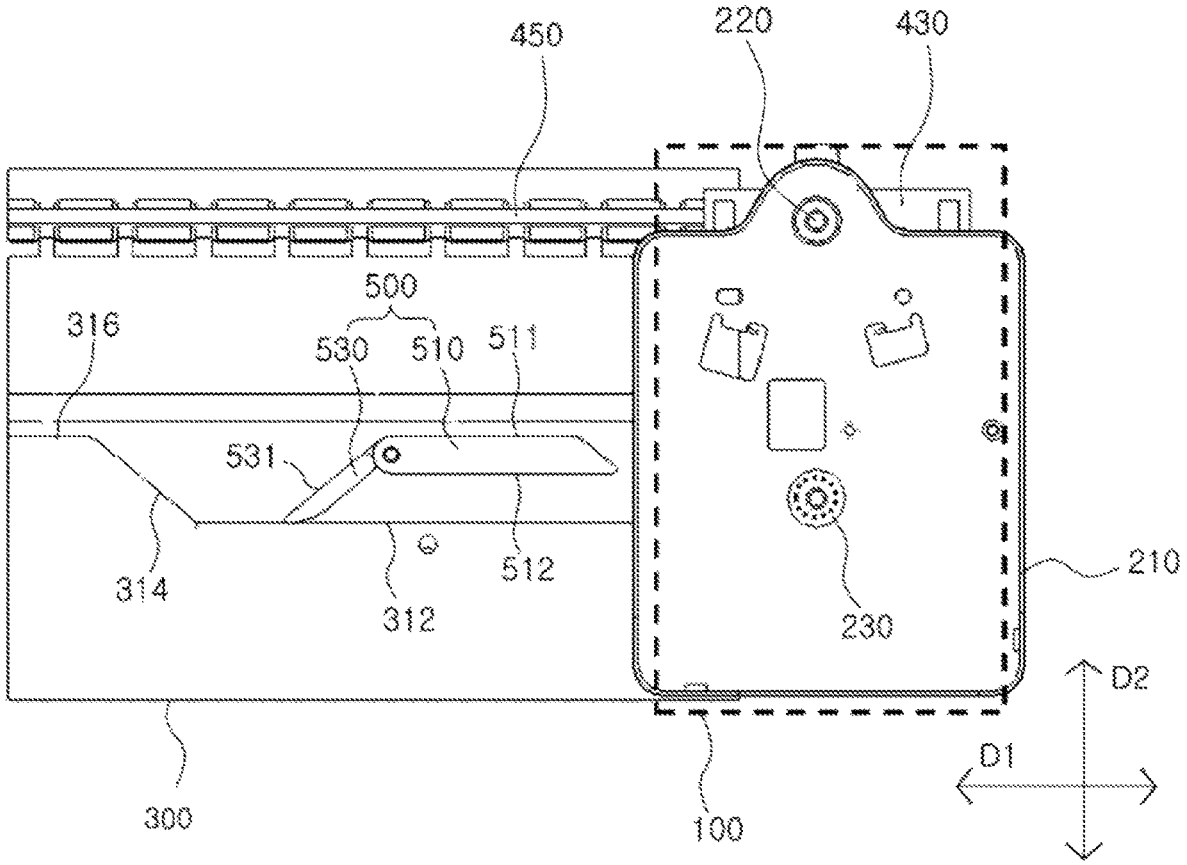
FIG. 4 is a view illustrating the stapling device of the paper finishing device illustrated in FIGS. 2 and 3 as viewed from above.
Figure 5:
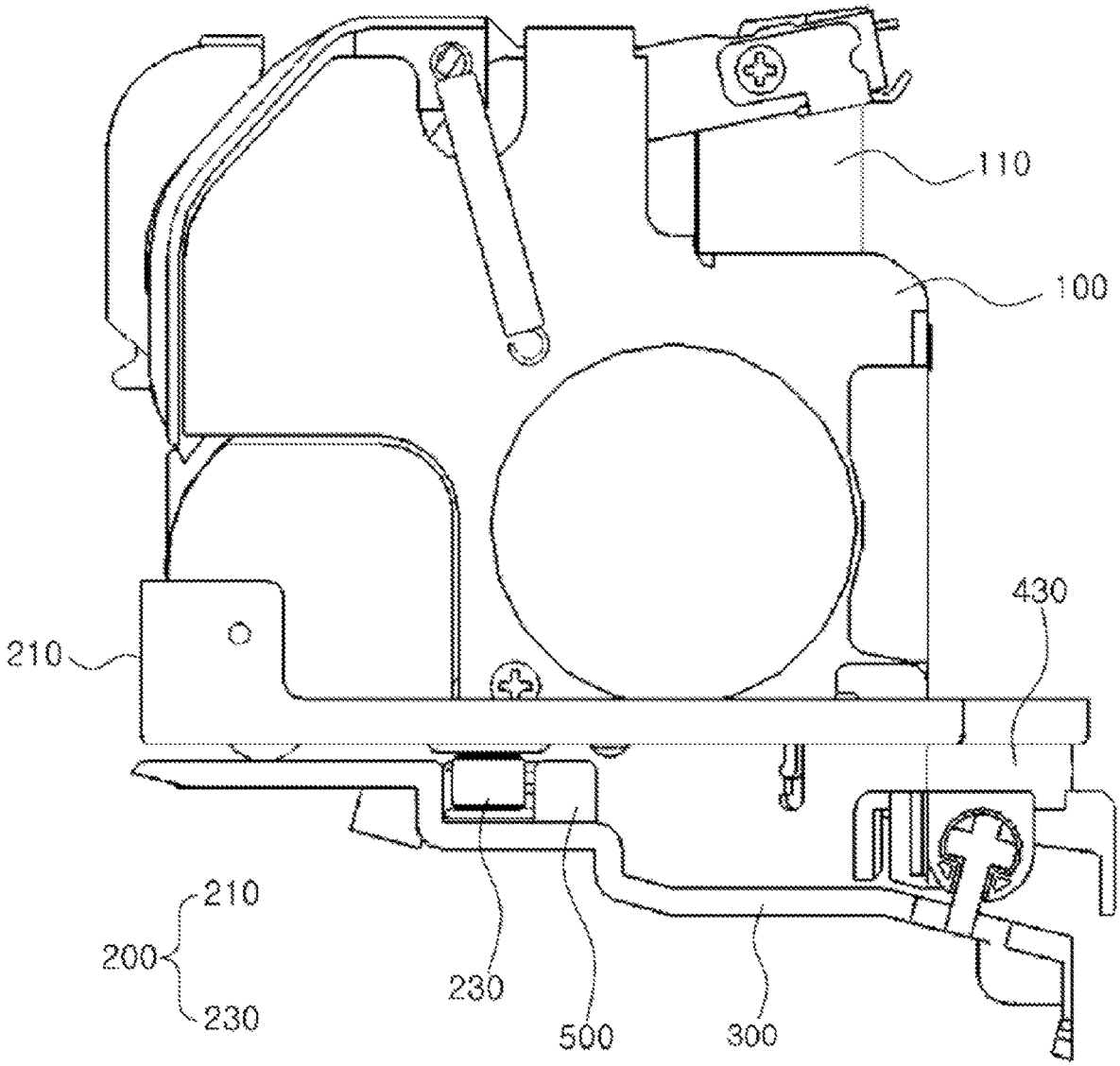
FIG. 5 is a view illustrating the stapling device of the paper finishing device illustrated in FIGS. 2 and 3 as viewed from the side.

FIGS. 2 and 3 are views illustrating a stapling device of a paper finishing device according to one embodiment of the present disclosure. FIG. 4 is a view illustrating the stapling device of the paper finishing device illustrated in FIGS. 2 and 3 as viewed from above. FIG. 5 is a view illustrating the stapling device of the paper finishing device illustrated in FIGS. 2 and 3 as viewed from the side.

A stapling device 50 of a paper finishing device of the present embodiment may be adopted as a device which is installed in a paper finishing device 30 (referred to as a finisher) to staple a processed and ejected paper bundle.

Here, the processing includes arranging or folding and ejecting sheets of the paper by the paper finishing device 30. The stapling device of the paper finishing device may move a stapler 100 in a direction D1 intersecting with an ejection direction of the paper ejected after performing the above-described processing and automatically staple the paper bundle. In addition, the stapling device 50 of the paper finishing device may also staple a paper bundle manually and externally inserted in a state in which the stapling device 50 moves to one end portion.

The stapling device 50 of the paper finishing device includes the stapler 100, a moving part 200, a base frame 300, a driving part 400, and a position guide part 500.

Figure 1:
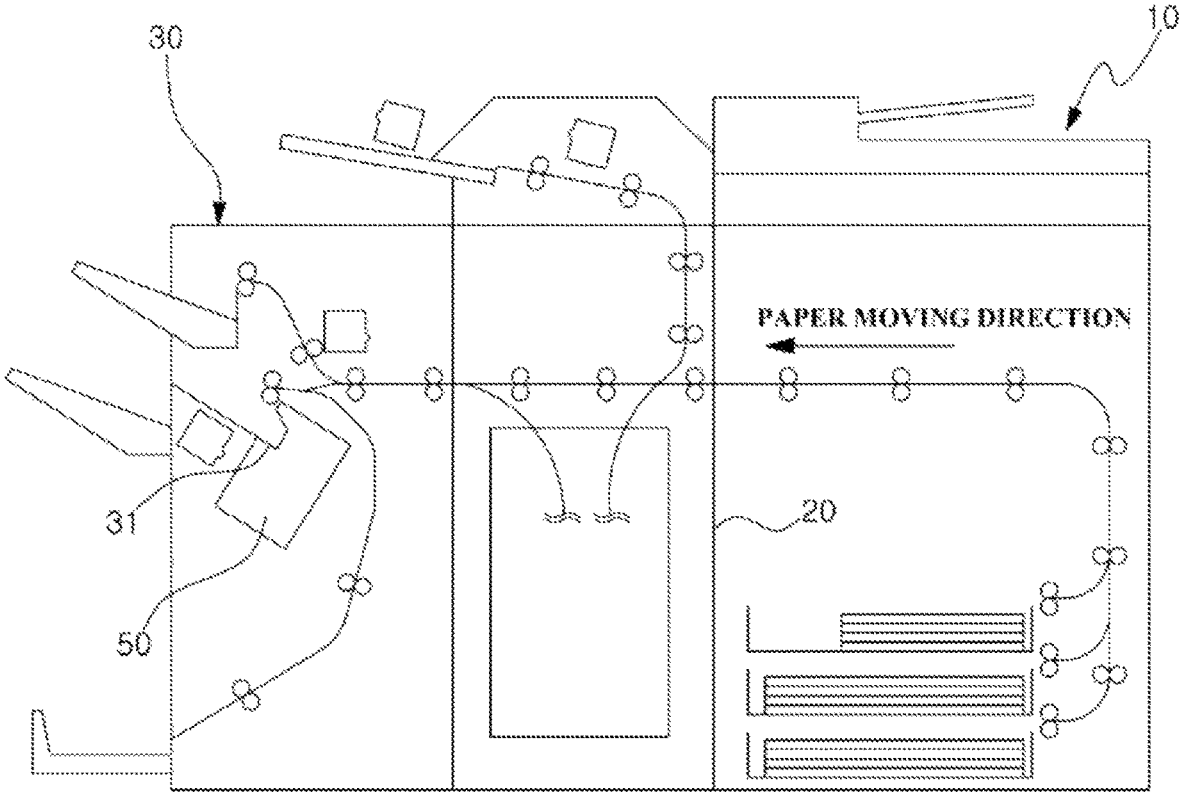
FIG. 1 is a view illustrating an example of an image forming device and a finishing device.

The stapler 100 may staple the paper bundle which is processed by and ejected from the paper finishing device 30 (see FIG. 1). The stapler 100 may automatically perform a stapling operation on the paper bundle according to a preset value or perform a stapling operation according to a manually input signal. The stapler 100 may include an entrance 110 into which one side of the arranged paper bundle is inserted.

The stapler 100 is installed on the moving part 200, and moving part 200 may be moved on the base frame 300 by the driving part 400. The moving part 200 will be further described below.

The base frame 300 may be positioned under the stapler 100 and provides a structure for a linear movement and a rotating movement of the stapler 100. For example, the base frame 300 may include a horizontal guide surface 312 extending along one side of paper to be inserted into the entrance 110 of the stapler 100, a first corner stapling guide surface 316 spaced apart from the horizontal guide surface 312, and a first inclined guide surface 314 which diagonally connects the horizontal guide surface 312 and the first corner stapling guide surface 316.

The base frame 300 may be a frame or support on which the horizontal guide surface 312, the first corner stapling guide surface 316, and the first inclined guide surface 314, which are described above, are formed.

The moving part 200 may be guided to be rotated for a first corner stapling mode by the first inclined guide surface 314 and the first corner stapling guide surface 316 which will be further described below.

The horizontal guide surface 312 may be parallel to the first corner stapling guide surface 316. In a plane which is coplanar with the horizontal guide surface 312 and the first corner stapling guide surface 316, a direction perpendicular to the horizontal guide surface 312 is defined as a vertical direction D2. The first inclined guide surface 314 may be diagonally connected to the horizontal guide surface 312 and the first corner stapling guide surface 316, that is, may be connected thereto to have an inclination angle.

The position guide part 500 may be installed on the base frame 300 to guide the moving part 200 to be rotated for a second corner stapling mode, which will be further described below.

The driving part 400 may be installed on the base frame 300 to move the moving part 200. The driving part 400 may include, for example, a motor 410, a belt 420, a stapler moving bush 430, and a guide rod 450. In addition, the driving part may also be variously changed.

The guide rod 450 may be installed on the base frame 300 and have a rod or rail shape extending parallel to the horizontal guide surface 312. The stapler moving bush 430 may be coupled to and slide on the guide rod 450. The belt 420 may be connected to the stapler moving bush 430. The belt 420 may slidably move the stapler moving bush 430 using power supplied from the motor 410 (see FIG. 2).

The moving part 200 may include a stapler moving bracket 210 and a moving roller 230.

The stapler 100 is seated on the stapler moving bracket 210. The stapler moving bracket 210 may be positioned between the stapler 100 and the base frame 300 to be moved by the driving part 400.

The stapler moving bracket 210 may be moved by the stapler moving bush 430. The stapler moving bracket 210 may be coupled to the stapler moving bush 430 to be rotatable by a rotary shaft 220.

The moving roller 230 may be installed on the stapler moving bracket 210, for example, on a lower surface thereof. When the moving roller 230 is positioned on the horizontal guide surface 312, the stapling device 50 is in a horizontal stapling mode.

Figure 11:
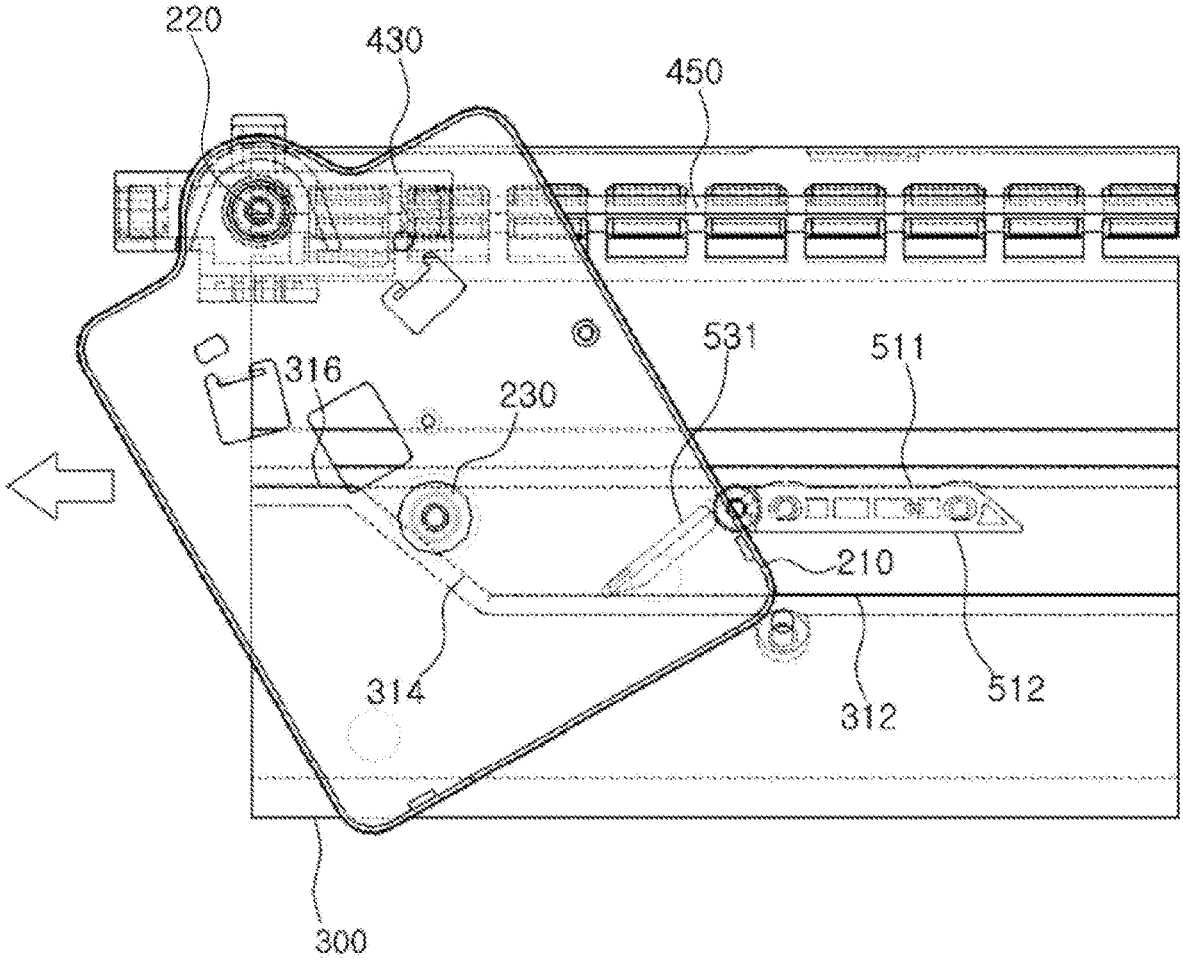
FIG. 11 is a view illustrating a state in which the moving roller is moving along the first inclined guide surface after colliding with the first inclined guide surface.

As the moving roller 230 collides with the first inclined guide surface 314 and moves along the first inclined guide surface 314, the stapler moving bracket 210 may rotate in a counterclockwise direction (see FIG. 11). Then, when the moving roller 230 is positioned on the first corner stapling guide surface 316, the stapler moving bracket 210 is rotated by a preset angle in the counterclockwise direction (the first corner stapling mode).

The position guide part 500 may be installed on the base frame 300 to guide the stapler moving bracket 210 to be rotated for the second corner stapling mode.

The position guide part 500 may include a side surface 512, a second corner stapling guide surface 511, and a second inclined guide surface 531.

The side surface 512 is positioned between the guide rod 450 and the horizontal guide surface 312 to face the horizontal guide surface 312. The moving roller 230 may be interposed and rolled between the horizontal guide surface 312 and the side surface 512.

The second corner stapling guide surface 511 faces the side surface 512, and the moving roller 230 may be positioned on the second corner stapling guide surface 511 in the second corner stapling mode.

The second inclined guide surface 531 may diagonally connect the horizontal guide surface 312 and the second corner stapling guide surface 511. For example, after the moving roller 230 collides with the second inclined guide surface 531, as the moving roller 230 rolls, the stapler moving bracket 210 may rotate in a clockwise direction (see FIG. 9). Then, when the moving roller 230 moves onto the second corner stapling guide surface 511, the stapler moving bracket 210 is rotated by a preset angle in the clockwise direction (the second corner stapling mode).

The position guide part 500 may have one of various structures in which the second corner stapling guide surface 511 and the second inclined guide surface 531 are provided. In the present embodiment, the position guide part 500 includes a position guide bar 510 and a guide gate 530.

The position guide bar 510 may be installed on the base frame 300 to be spaced apart from the horizontal guide surface 312. The position guide bar 510 may include the side surface 512 facing the horizontal guide surface 312.

Another side surface opposite to the side surface 512 of the position guide bar 510, that is, a surface, which faces the guide rod 450, of the position guide bar 510, is the second corner stapling guide surface 511. The second corner stapling guide surface 511 may be positioned to be collinear with the first corner stapling guide surface 316. However, vertical distances from the first corner stapling guide surface 316 and the second corner stapling guide surface 511 to the horizontal guide surface 312 may be different from each other.

One end of the guide gate 530 is rotatably coupled to an end portion of the position guide bar 510, and the other end may be in contact with the horizontal guide surface 312. An upper surface of the guide gate 530 is the second inclined guide surface 531. Accordingly, the second inclined guide surface 531 may diagonally connect the horizontal guide surface 312 and the second corner stapling guide surface 511.

Distances from the first corner stapling guide surface 316 and the second corner stapling guide surface 511 to the guide rod 450 are smaller than a distance from the horizontal guide surface 312 to the guide rod 450. In addition, a distance between the rotary shaft 220 of the stapler moving bracket 210 and the moving roller 230 with respect to the stapler moving bush 430 is greater than a distance from each of the first corner stapling guide surface 316 and the second corner stapling guide surface 511 to the guide rod 450. With respect to the vertical direction D2, the first inclined guide surface 314 may be formed to be inclined in the counterclockwise direction, and the second inclined guide surface 531 may be formed in the clockwise direction.

Due to such distance relationships and relationships between the rotary shaft 220, the moving roller 230, and the guide surfaces, the stapler moving bracket 210 may perform the rotating movement and the linear movement.

Figure 6:
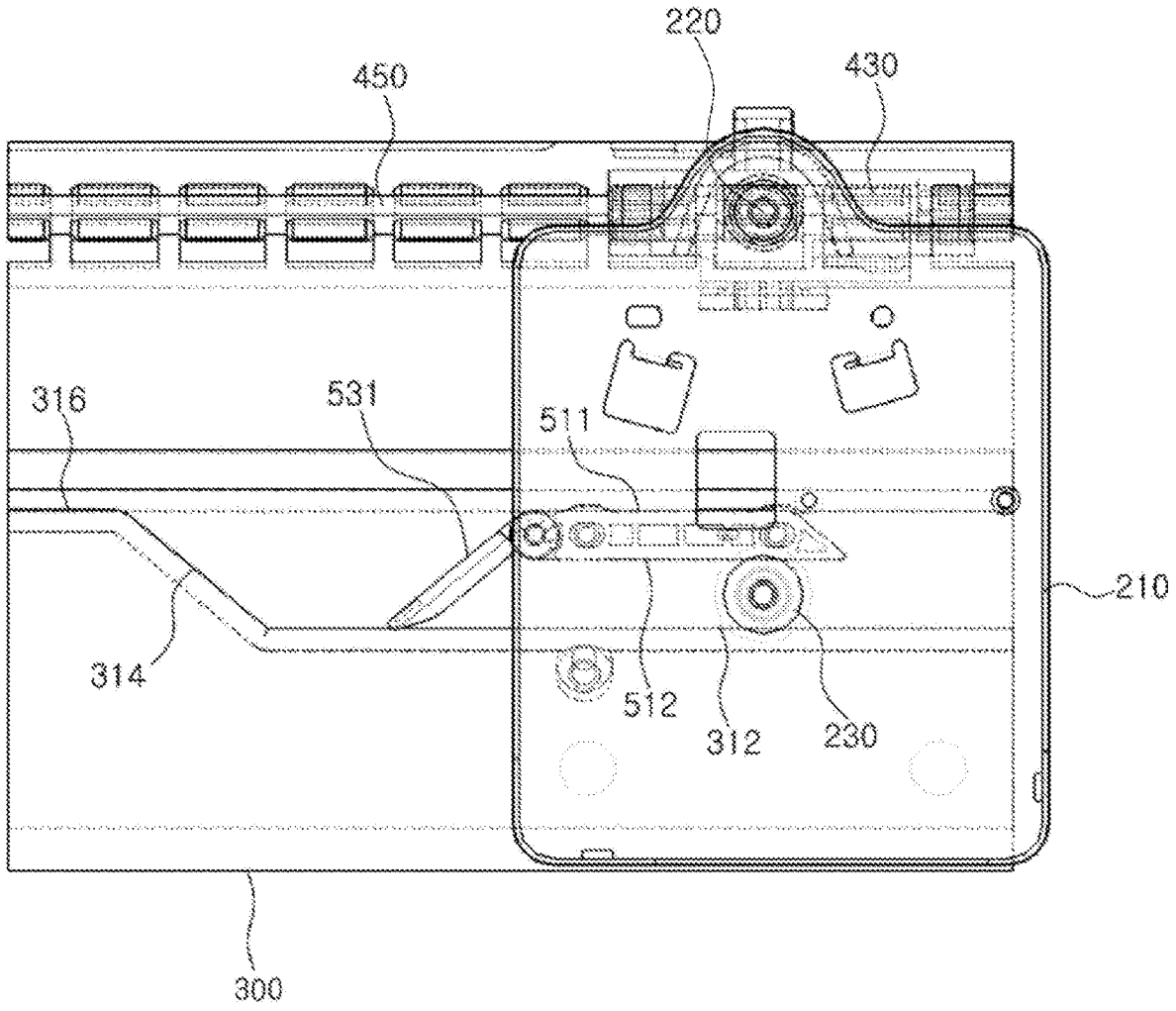
FIG. 6 is a view illustrating a state in which a moving roller is positioned between a horizontal guide surface and a side surface of a position guide part in a horizontal stapling mode.
Figure 7:
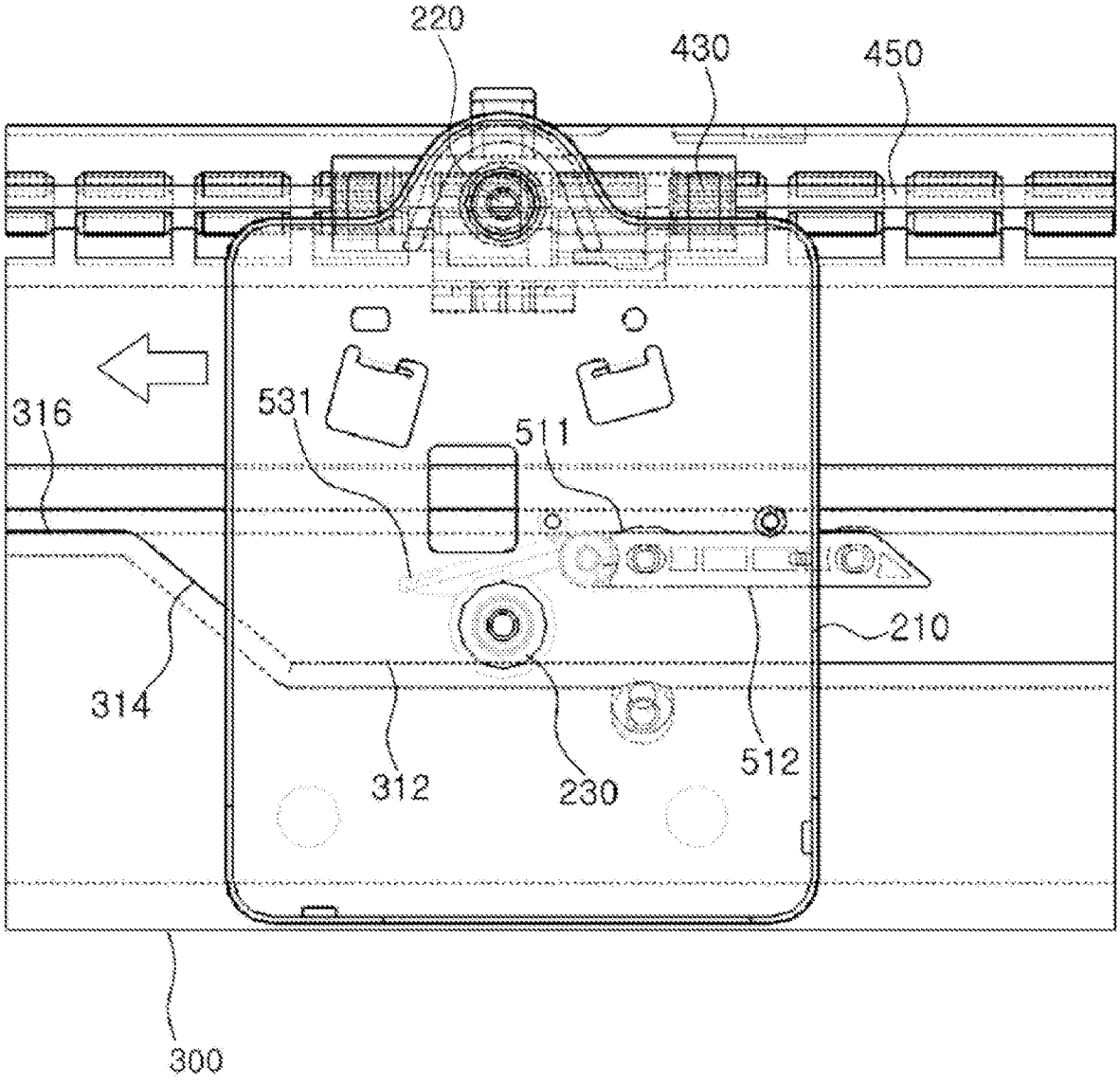
FIG. 7 is a view illustrating a state in which the moving roller is moving from the horizontal guide surface and opening and passing through a guide gate.
Figure 8:
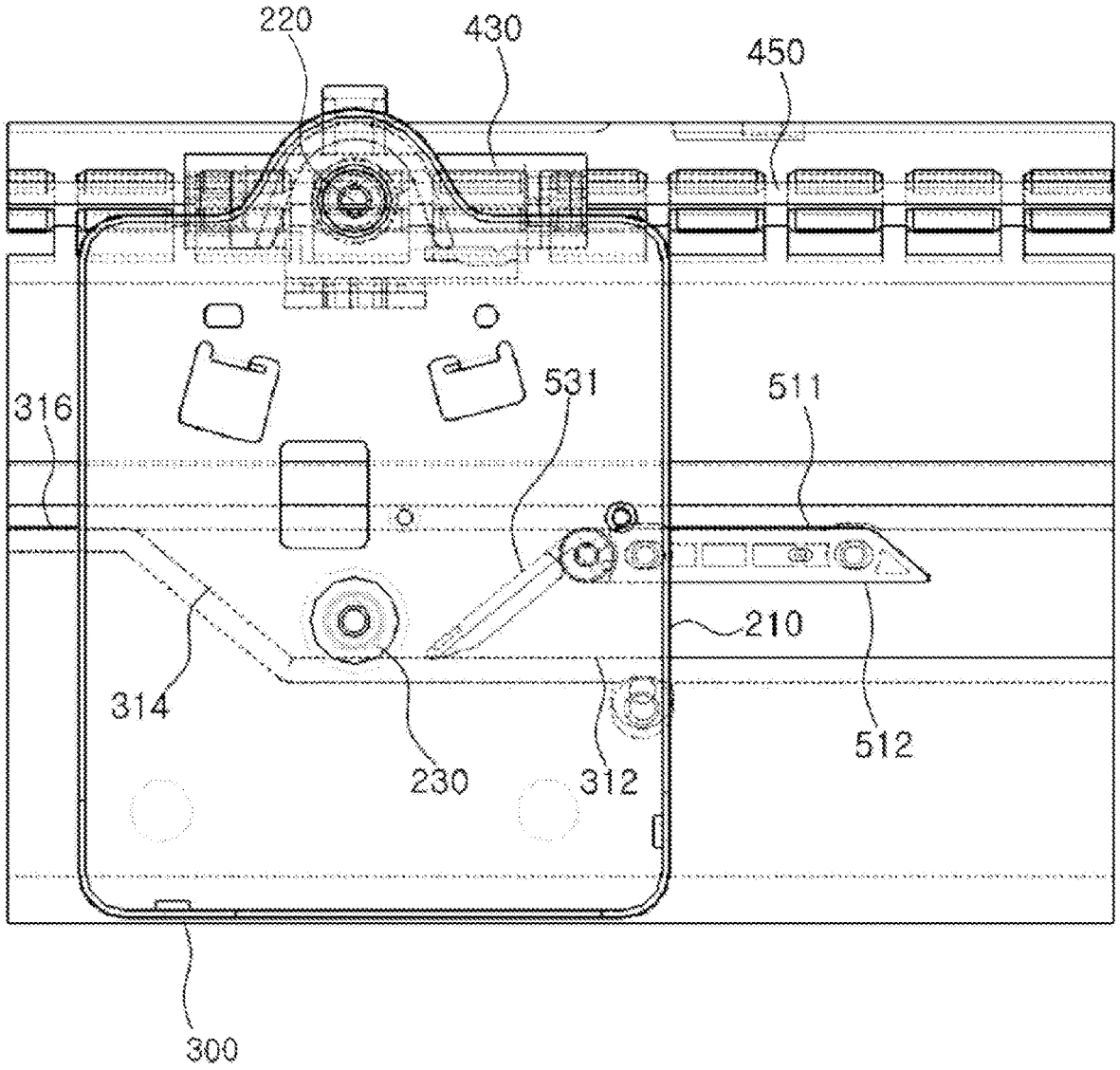
FIG. 8 is a view illustrating a state in which the moving roller is positioned on the horizontal guide surface disposed between a first inclined guide surface and a second inclined guide surface.

FIG. 6 is a view illustrating a state in which the moving roller 230 is positioned between the horizontal guide surface 312 and the side surface 512 of the position guide bar 510 in the horizontal stapling mode. FIG. 7 is a view illustrating a state in which the moving roller 230 is moving from the horizontal guide surface 312 and opening and passing through the guide gate 530. FIG. 8 is a view illustrating a state in which the moving roller 230 is positioned on the horizontal guide surface 312 disposed between the first inclined guide surface 314 and the second inclined guide surface 531;

In the horizontal stapling mode, the moving roller 230 is moved along the horizontal guide surface 312 by the driving part 400, and then, the stapler 100 may move to a required position or preset position and perform horizontal stapling.

In the horizontal stapling mode, the moving roller 230 may be positioned between the horizontal guide surface 312 and the side surface 512, or the moving roller 230 may be positioned on the horizontal guide surface 312 in a state in which the moving roller 230 is moving toward the first inclined guide surface 314 and pushing and opening the guide gate 530 or after the moving roller 230 opens and passes through the guide gate 530.

The guide gate 530 may be returned to an original position by a restoring force or the gravity after the moving roller 230 opens and passes through the guide gate 530.

For example, as illustrated in FIG. 6, while the moving roller 230 laterally moves between the horizontal guide surface 312 and the side surface 512, the horizontal stapling may be performed at a preset position or required position. Alternatively, as necessary, as illustrated in FIG. 7, the moving roller 230 may further move in a leftward direction to collide with the guide gate 530, and then, the guide gate 530 may be rotated and opened, and the moving roller 230 may pass through the guide gate 530. Accordingly, at a position at which the guide gate 530 is opened, or on the horizontal guide surface 312 between the first inclined guide surface 314 and the second inclined guide surface 531 as illustrated in FIG. 8, the horizontal stapling may also be performed.

Figure 9:
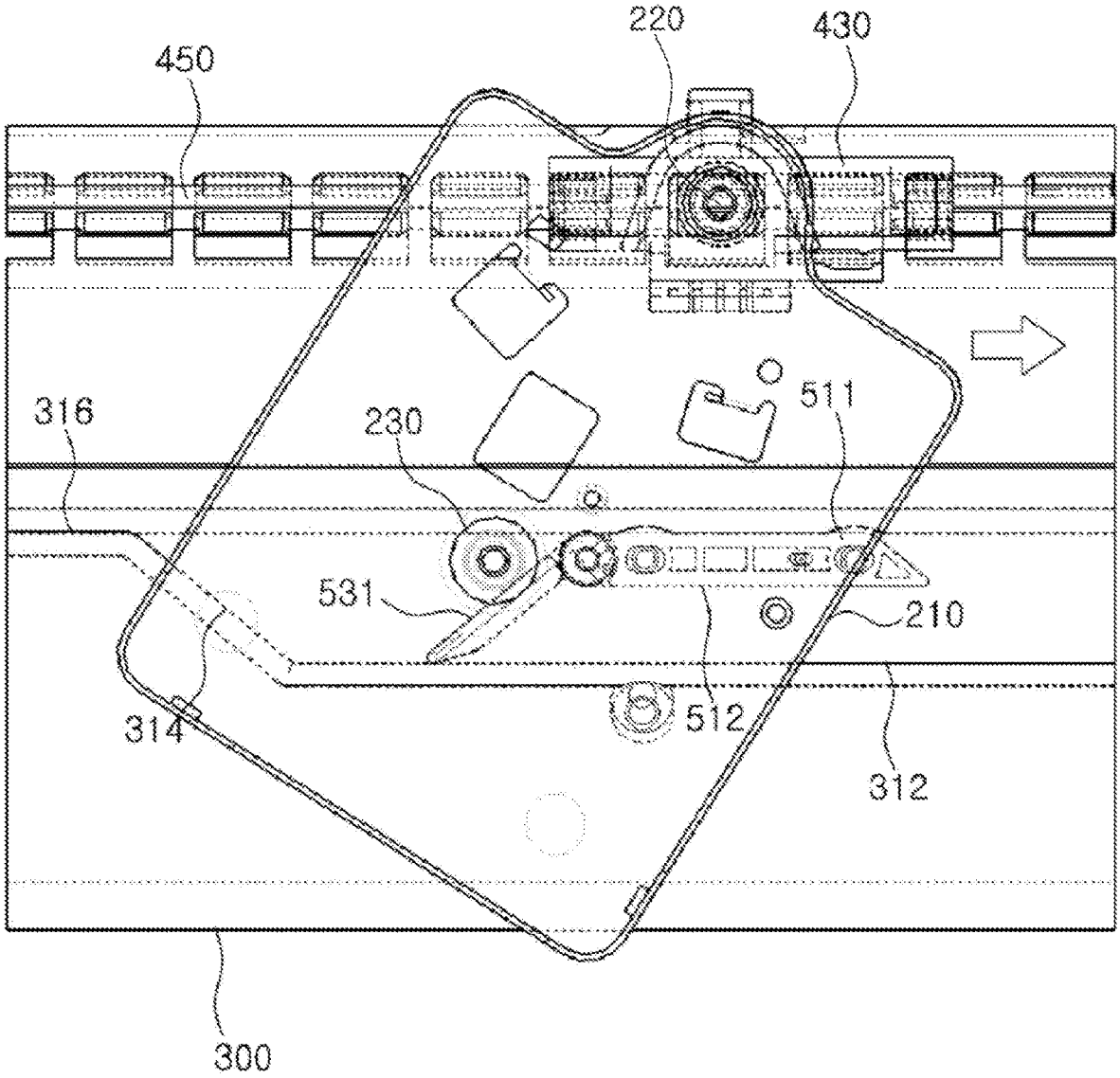
FIG. 9 is a view illustrating a state in which the moving roller is moving along the second inclined guide surface after colliding with the second inclined guide surface.
Figure 10:
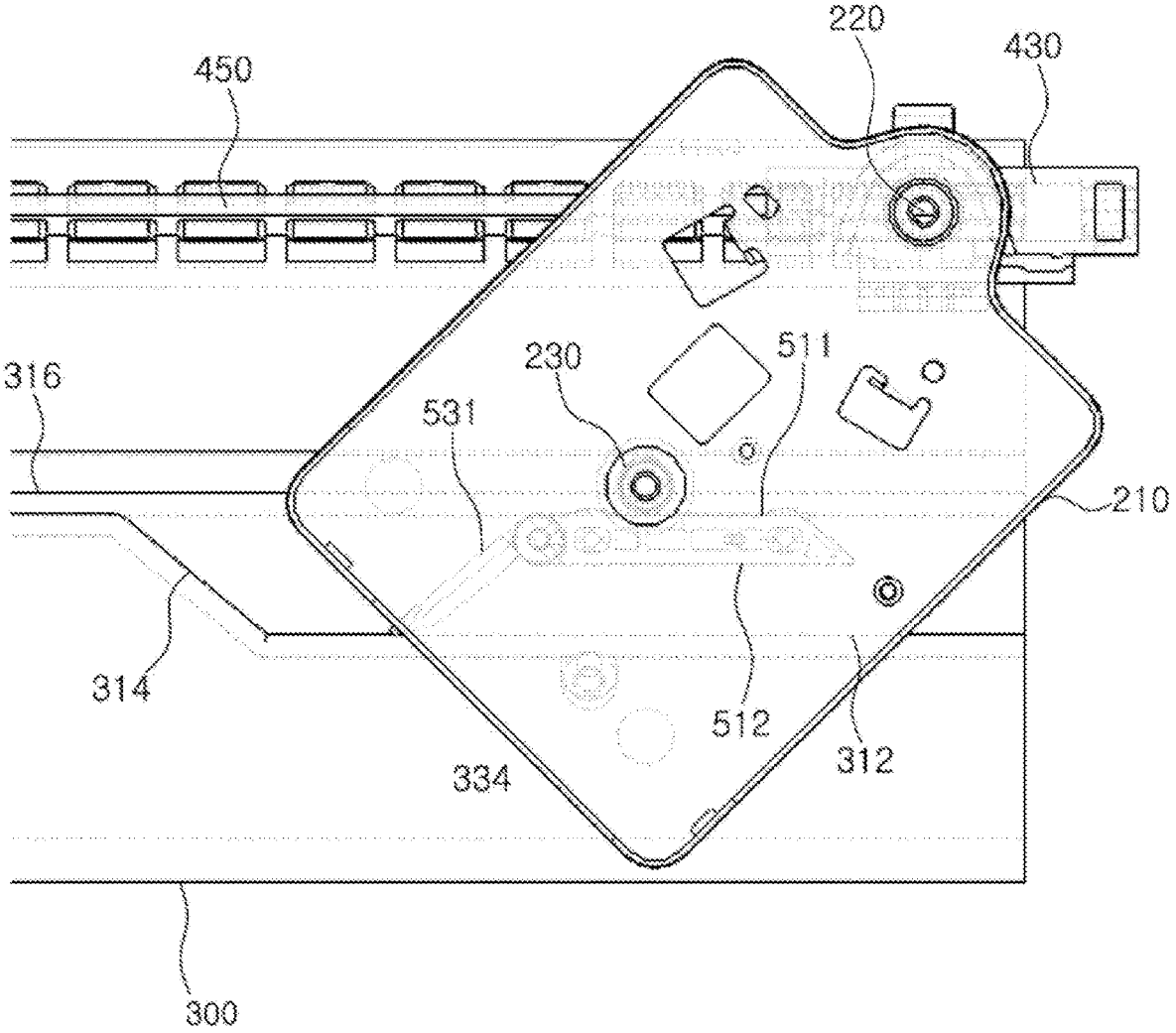
FIG. 10 is a view illustrating a state in which the moving roller is moved from the second inclined guide surface to the second corner stapling guide surface.

FIG. 9 is a view illustrating a state in which the moving roller 230 is moving along the second inclined guide surface 531 after moving along the horizontal guide surface 312 and colliding with the second inclined guide surface 531. FIG. 10 is a view illustrating a state in which the moving roller 230 is moved from the second inclined guide surface 531 to the second corner stapling guide surface 511.

As illustrated in FIGS. 9 and 10, after the moving roller 230 opens and passes through the guide gate 530, the moving roller 230 positioned on the horizontal guide surface 312 disposed between the first inclined guide surface 314 and the second inclined guide surface 531 collides with the second inclined guide surface 531, rolls along the second inclined guide surface 531, and moves to the second corner stapling guide surface 511 in the second corner stapling mode.

For example, the stapler moving bush 430 is slid in a rightward direction by the driving part 400 to move the stapler moving bracket 210. Accordingly, in a case in which the moving roller 230 is moved in the rightward direction as illustrated in FIG. 9, since the moving roller 230 collides with the second inclined guide surface 531, the guide gate 530 is not opened, and the other end of the guide gate 530 is supported by the horizontal guide surface 312. Accordingly, the moving roller 230 may roll along the second inclined guide surface 531.

The moving roller 230 moves to the second corner stapling guide surface 511 along the second inclined guide surface 531, and accordingly, the stapler moving bracket 210 rotates in the clockwise direction. Accordingly, the stapler 100 installed on the stapler moving bracket 210 also rotates in the clockwise direction so that diagonal stapling, inclined stapling, or second corner stapling may be performed.

Figure 12:
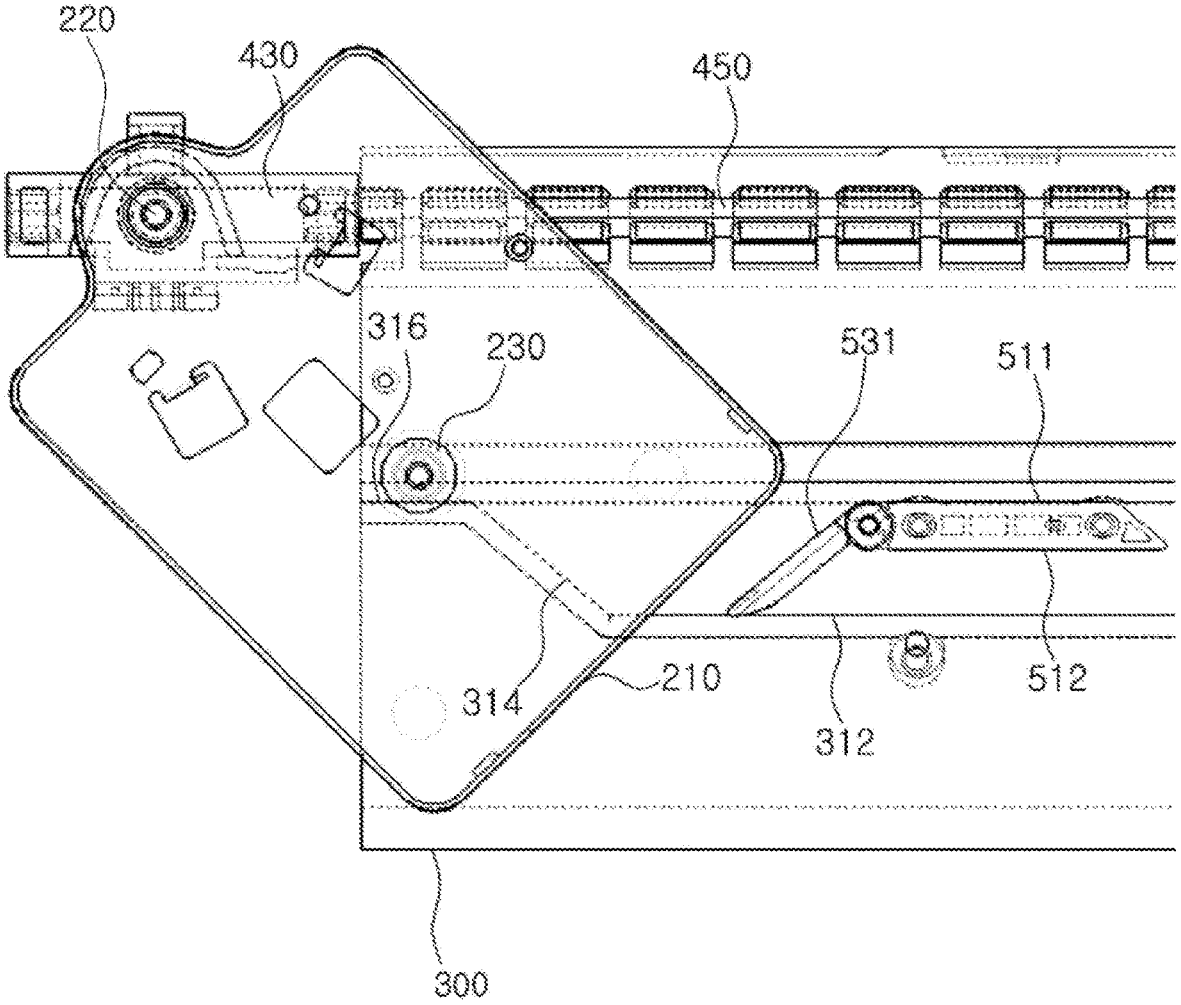
FIG. 12 is a view illustrating a state in which the moving roller is moved from the first inclined guide surface to the first corner stapling guide surface.

FIG. 11 is a view illustrating a state in which the moving roller 230 is moving along the horizontal guide surface 312 and along the first inclined guide surface 314. FIG. 12 is a view illustrating a state in which the moving roller 230 is moved from the first inclined guide surface 314 to the first corner stapling guide surface 316.

In the first corner stapling mode, the moving roller 230 rolls along the first inclined guide surface 314 to move to the first corner stapling guide surface 316.

For example, in a state illustrated in FIG. 8, the moving roller 230 moves in the leftward direction as illustrated in FIG. 11. That is, while the stapler moving bush 430 moves in the leftward direction along the guide rod 450, the stapler moving bracket 210 moves in the leftward direction. Accordingly, since the moving roller 230 rolls along the first inclined guide surface 314 after colliding with the first inclined guide surface 314, the stapler moving bracket 210 rotates in the counterclockwise direction. Then, when the moving roller 230 is positioned on the first corner stapling guide surface 316, the stapler 100 rotates by a preset angle in the counterclockwise direction so that the first corner stapling may be performed.

Meanwhile, referring to FIG. 10 again, the moving roller 230 positioned on the second corner stapling guide surface 511 further moves in the rightward direction, the moving roller is separated from an end of the second corner stapling guide surface 511 toward the horizontal guide surface 312. That is, the moving roller is returned to a horizontal stapling position from the second corner stapling mode.

As described above, the rotating movement and the linear movement of the stapler 100 are performed by simply moving the guide surfaces without providing a complex structure and performing complicated control. That is, since the structure for performing such movements is concise and simple, operational reliability, speed, and accuracy are improved, control is convenient, and there are many advantages in manufacturing.

Figure 13:
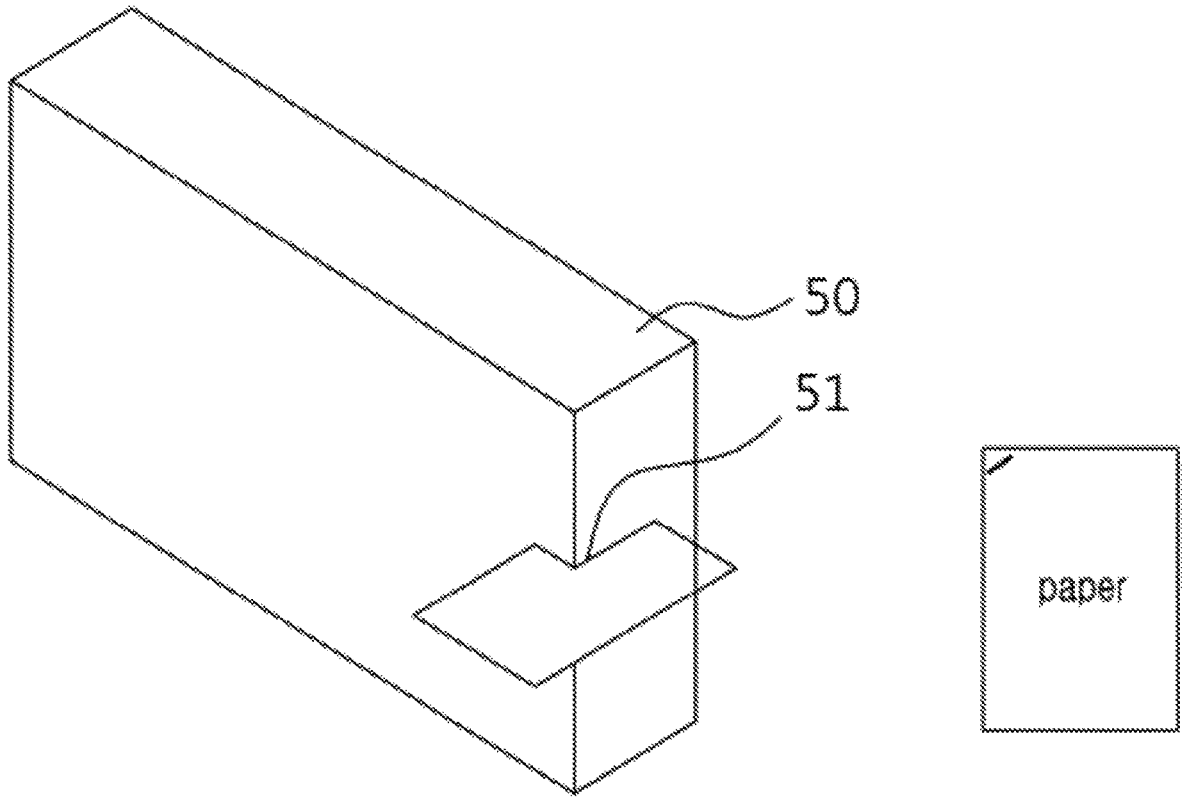
FIG. 13 is a schematic view illustrating an exterior of a finishing device in which the stapling device of the paper finishing device of the present disclosure is employed and showing a manual stapling operation.

FIG. 13 is a schematic view illustrating an exterior of the paper finishing device 30 in which the stapling device of the paper finishing device of the present disclosure is employed and showing a manual stapling operation.

The above-described horizontal stapling, first corner stapling, and second corner stapling may be applied when stapling is automatically performed at a preset position.

Meanwhile, any one of the first corner stapling and second corner stapling may also be used for manual stapling.

For example, as illustrated in FIG. 13, a manual slot is formed in a corner of one side of the stapling device 50 of the paper finishing device, and when a user directly and externally inserts a paper bundle thereinto, and operates the stapling device 50 of the paper finishing device, the stapler 100 may also be operated to move to a first corner stapling position and perform stapling.

According to the present disclosure, a stapling device of a paper finishing device, of which a structure is simple, control is easy, operational reliability is improved, can be provided because a linear movement and a rotating movement can be performed to change a posture of a stapler used in the paper finishing device by only providing horizontal and inclined guide surfaces without providing a complex structure and moving a stapler moving bracket along the horizontal and inclined guide surfaces.

What is claimed is:

1. A stapling device of a paper finishing device, which is installed to staple a paper bundle ejected from an image forming device, the stapling device comprising:

a stapler including an entrance into which one side of paper is inserted;

a moving part including a stapler moving bracket on which the stapler is seated, and a moving roller installed on the stapler moving bracket;

a driving part which moves the stapler moving bracket;

a base frame on which the stapler moving bracket and the driving part are installed and which includes a horizontal guide surface extending along the one side of the paper, a first corner stapling guide surface spaced apart from the horizontal guide surface, and a first inclined guide surface which diagonally connects the horizontal guide surface and the first corner stapling guide surface; and a position guide part which is installed on the base frame and includes a second corner stapling guide surface and a second inclined guide surface which diagonally connects the horizontal guide surface and the second corner stapling guide surface and is inclined to be opposite to the first inclined guide surface, wherein, when the moving roller is positioned on the horizontal guide surface, the stapling device is in a horizontal stapling mode, when the moving roller is moved along the first inclined guide surface and positioned on the first corner stapling guide surface, the stapling device is in a first corner stapling mode in which the stapler moving bracket is positioned to be inclined in a counterclockwise direction, and when the moving roller is moved along the second inclined guide surface and positioned on the second corner stapling guide surface, the stapling device is in a second corner stapling mode in which the stapler moving bracket is positioned to be inclined in a clockwise direction.

2. The stapling device of claim 1, wherein the position guide part includes:

a position guide bar including the second corner stapling guide surface; and a guide gate of which one end is rotatably coupled to the position guide bar and the other end is positioned on the horizontal guide surface and on which the second inclined guide surface is formed.

3. The stapling device of claim 2, wherein, based on a direction perpendicular to the horizontal guide surface:

the first inclined guide surface is inclined in the counterclockwise direction;

the second inclined guide surface is inclined in the clockwise direction; and the first corner stapling guide surface and the second corner stapling guide surface are parallel to the horizontal guide surface.

4. The stapling device of claim 2, wherein, in the horizontal stapling mode:

the moving roller is positionable at a selected position on the horizontal guide surface; and the moving roller is also positionable on the horizontal guide surface in a state in which the moving roller is moving on the horizontal guide surface toward the first inclined guide surface and pushing and opening the guide gate or after the moving roller opens and passes through the guide gate.

5. The stapling device of claim 4, wherein, after the moving roller opens and passes through the guide gate, the guide gate is returned to an original position by a restoring force or gravity.

6. The stapling device of claim 4, wherein, after the moving roller opens and passes through the guide gate, the moving roller positioned between the first inclined guide surface and the second inclined guide surface:

collides with the first inclined guide surface, rolls along the first inclined guide surface, and moves to the first corner stapling guide surface in the first corner stapling mode; and collides with the second inclined guide surface, rolls along the second inclined guide surface, and moves to the second corner stapling guide surface in the second corner stapling mode.

7. The stapling device of claim 6, wherein:

as the moving roller collides with the first inclined guide surface and rolls along the first inclined guide surface, the stapler moving bracket rotates in the counterclockwise direction; and as the moving roller collides with the second inclined guide surface and rolls along the second inclined guide surface, the stapler moving bracket rotates in the clockwise direction.

8. The stapling device of claim 6, wherein the moving roller is separated from an end of the second corner stapling guide surface toward the horizontal guide surface and returned to the horizontal stapling mode.

9. The stapling device of claim 1, wherein the driving part includes:

a guide rod installed on the base frame to be parallel to the horizontal guide surface; and a stapler moving bush which slides along the guide rod and is installed on the stapler moving bracket so that the stapler moving bracket is rotatable.

10. The stapling device of claim 9, wherein a distance between a rotary shaft of the stapler moving bracket and the moving roller with respect to the stapler moving bush is greater than a distance from each of the first corner stapling guide surface and the second corner stapling guide surface to the guide rod.

* * * * *